US008096723B2

(12) United States Patent
Bae

(10) Patent No.: US 8,096,723 B2
(45) Date of Patent: Jan. 17, 2012

(54) SWIVEL SQUEEGEE 360

(76) Inventor: Jinsoo James Bae, Algonquin, IL (US)

( * ) Notice: Subject to any disclaimer, the term of this patent is extended or adjusted under 35 U.S.C. 154(b) by 820 days.

(21) Appl. No.: 12/193,901

(22) Filed: Aug. 19, 2008

(65) Prior Publication Data

US 2009/0049636 A1 Feb. 26, 2009

Related U.S. Application Data

(60) Provisional application No. 60/965,560, filed on Aug. 20, 2007.

(51) Int. Cl.
*A47L 13/26* (2006.01)

(52) U.S. Cl. ..... 401/139

(58) Field of Classification Search ..... 401/137–139, 401/261, 263–266, 188 R
See application file for complete search history.

(56) References Cited

U.S. PATENT DOCUMENTS

| | | | | | |
|---|---|---|---|---|---|
| 2,741,789 | A * | 4/1956 | Ray | 401/139 |
| 4,776,716 | A * | 10/1988 | Huang | 401/139 |
| D308,139 | S * | 5/1990 | Viner | D4/118 |
| 5,536,095 | A * | 7/1996 | Diamond | 401/146 |
| D386,852 | S * | 11/1997 | Viner | D32/42 |
| 7,155,770 | B2 * | 1/2007 | Anderson et al. | 15/111 |

* cited by examiner

*Primary Examiner* — Huyen Le

(57) ABSTRACT

A squeegee with a swiveling squeegee handle and squeegee head with a detachable squeegee blade container with affixed squeegee blade and spraying device enclosed in the squeegee handle. The squeegee head has an elongated groove or notch on top of the squeegee head allowing squeegee blade in various size and shape to be fasten on to the squeegee head, and clamp like devices attach at the rear of the squeegee head to fasten a wiping material across the front surface of the squeegee head. The squeegee blade container and an enclosed squeegee blade, and wiping material are detachable from the squeegee head. The squeegee handle has an enclosed container for holding liquid and an attached sprayer/pump for dispensing the contained liquid, and threaded squeegee handle to allow extended poles to be attached to provide longer reach. The swivel joints allow extensions, squeegee handle and/or squeegee head, to swivel and locked to an angled position or swivel with specified degree of resistance.

8 Claims, 5 Drawing Sheets

SWIVEL SQUEEGEE 360

CROSS-REFERENCE TO RELATED APPLICATIONS

This application claims priority based on U.S. provisional patent application 60/965,560, filed on Aug. 20, 2007 and entitled "Swivel squeegee 360", by Jinsoo James Bae.

STATEMENT REGARDING FEDERALLY SPONSORED RESEARCH/DEVELOPMENT

Not applicable.

BACKGROUND OF THE INVENTION

The present invention relates to devices for cleaning windows, in particular, to a squeegee with a handle. More particularly, it relates to wiping devices that have a squeegee head with a blade, have a squeegee handle with enclosed container to hold and dispense liquid, and have an ability to swivel.

There are many utility patents relating to window cleaning devices. There were several squeegee patents where squeegee handle contained spraying devices to dispense liquid for cleaning and/or squeegee handle with mountable extension pole. See e.g. U.S. Pat. Nos. 6,692,171, 6,547,469, 6,010,267, 4,776,716, and U.S. Pub. App. No. 20060188320.

BRIEF SUMMARY OF THE INVENTION

The present invention, Swivel Squeegee 360, is a newly designed and enhanced squeegee, window cleaner, with a swiveling squeegee handle and/or squeegee head with a detachable squeegee blade container with affixed squeegee blade, and spraying device enclosed in the squeegee handle.

The squeegee head has an elongated groove or notch on top of the squeegee head allowing squeegee blade in various size and shape to be fasten on to the squeegee head, and clamp like devices attach at the rear of the squeegee head to fasten a wiping material across the front surface of the squeegee head.

The squeegee blade container and an enclosed squeegee blade, and wiping material are detachable from the squeegee head. The squeegee handle has an enclosed container for holding liquid and an attached sprayer/pump for dispensing the contained liquid, and threaded squeegee handle to allow extended poles to be attached to provide longer reach.

The swivel joints allow extensions, squeegee handle and/or squeegee head, to swivel and locked to an angled position or swivel with specified degree of resistance

DETAILED DESCRIPTION OF THE PREFERRED EMBODIMENTS

Figure 1:
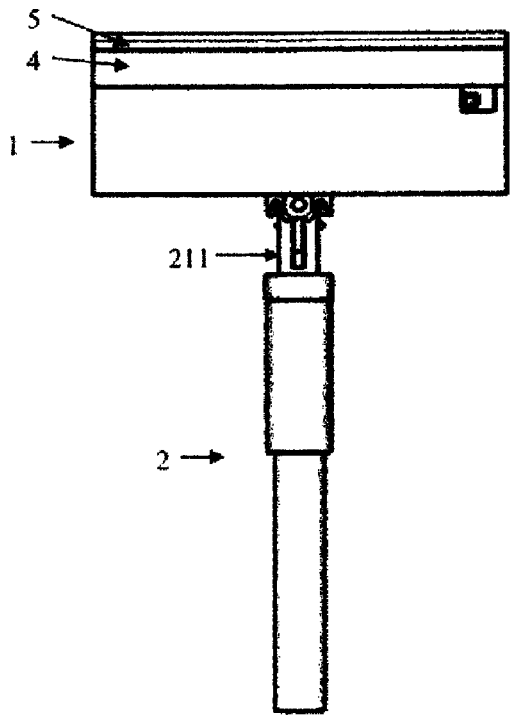
FIG. 1 shows a front view of the present invention squeegee with swiveling squeegee handle and/or squeegee head with detachable squeegee blade container with affixed squeegee blade and sprayer.
Figure 2:
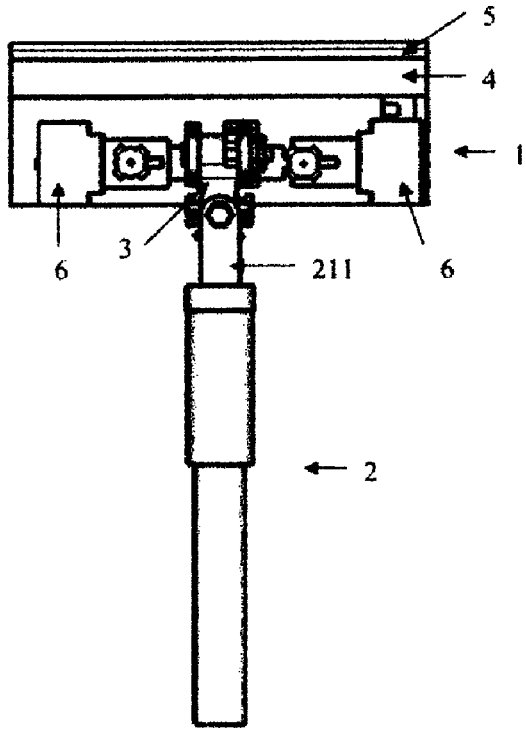
FIG. 2 shows a rear view of the present invention squeegee with swiveling squeegee handle and/or squeegee head with detachable squeegee blade container with affixed squeegee blade and sprayer.
Figure 3:
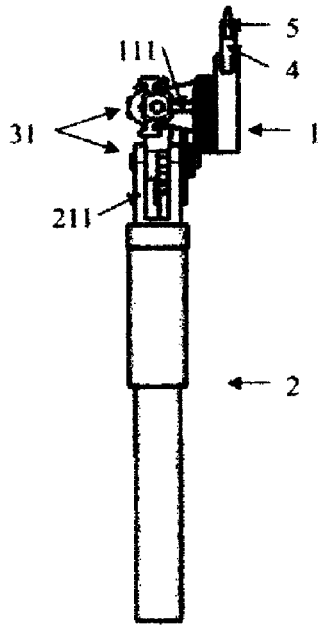
FIG. 3 shows a side view of the present invention squeegee with swiveling squeegee handle and/or squeegee head with detachable squeegee blade container with affixed squeegee blade and sprayer.
Figure 4:
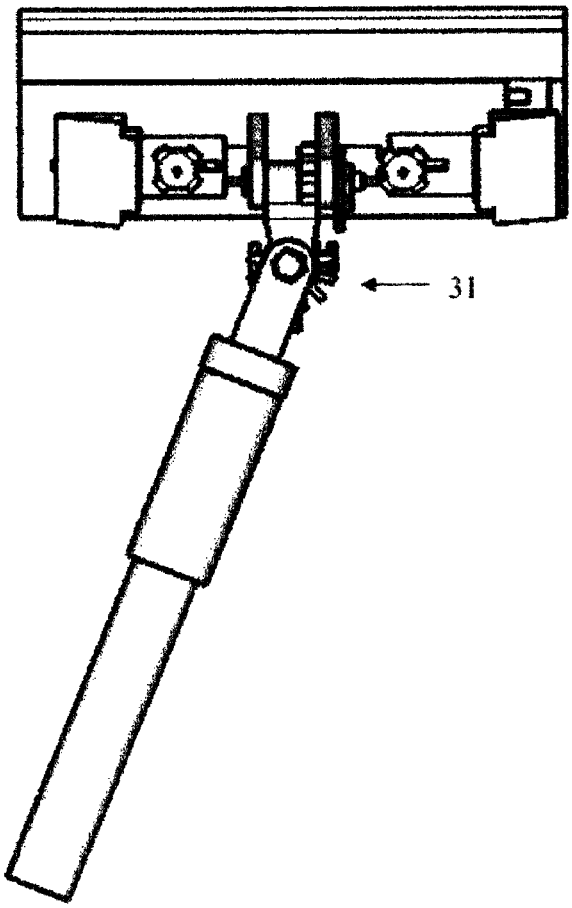
FIG. 4 shows a rear view of the present invention squeegee with swiveling squeegee handle and/or squeegee head with detachable squeegee blade container with affixed squeegee blade and sprayer having squeegee handle swiveled laterally.
Figure 5:
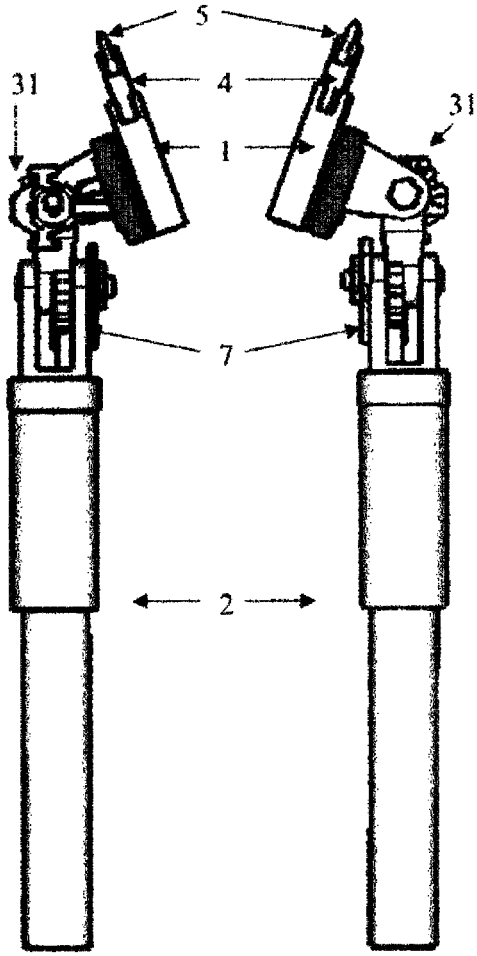
FIG. 5 shows a side view of the present invention squeegee with swiveling squeegee handle and/or squeegee head with detachable squeegee blade container with affixed squeegee blade and sprayer having squeegee head swiveled vertically.

The present invention is a squeegee with swiveling squeegee handle and/or squeegee head with detachable squeegee blade container with affixed squeegee blade and spraying device enclosed in the squeegee handle. The squeegee has an elongated groove or notch on the top of the squeegee head allowing squeegee blade container in various size and shape to be fasten on to the squeegee head, and clamp like devices affixed at the rear to attach a wiping material across the front surface of the squeegee head. The squeegee blade container and affixed squeegee blade, and wiping material are detachable from the squeegee head. The squeegee handle has an enclosed container for holding liquid and an attached sprayer/pump for dispensing the contained liquid, and threaded squeegee handle to allow extended poles to be attached to provide longer reach. As shown in FIG. 1, FIG. 2, and FIG. 3, the swivel joint connector 3 integrates the squeegee head 1 and the squeegee handle 2 to form the squeegee. The swivel joints 31 allow extensions, squeegee handle 2 and squeegee head 1, to swivel and lock to an angled position or swivel with specified degree of resistance.

Figure 8:
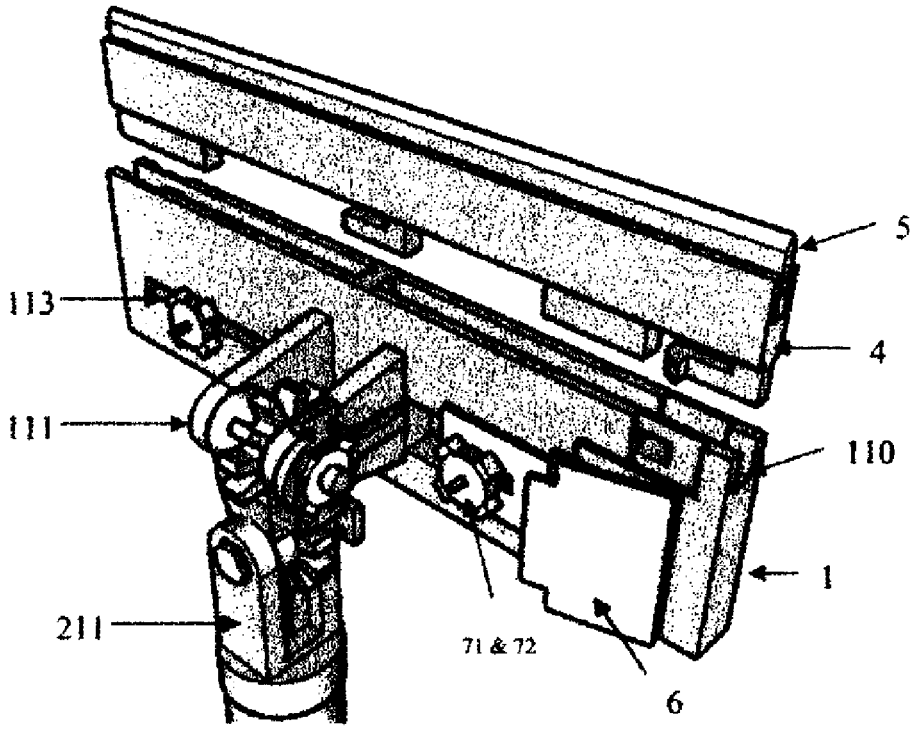
FIG. 8 shows a view of detached squeegee blade container with affixed squeegee blade from the present invention squeegee with swiveling squeegee handle and/or squeegee head with detachable squeegee blade container with affixed squeegee blade and sprayer.

Referring to FIG. 8, the squeegee head 1 is an elongated rectangular shaped widget having a groove/notch on top of the head 110 to interlock and fasten the squeegee blade container 4, a groove/notch at the rear of the squeegee head 113 to affix a clamp like device 6 by components like nut and bolt 71 & 72, and a pair of ears 111 with bearing bore 112 of yoke clamp like device protruding from the rear to connect to swivel joint connector 3.

Figure 11:
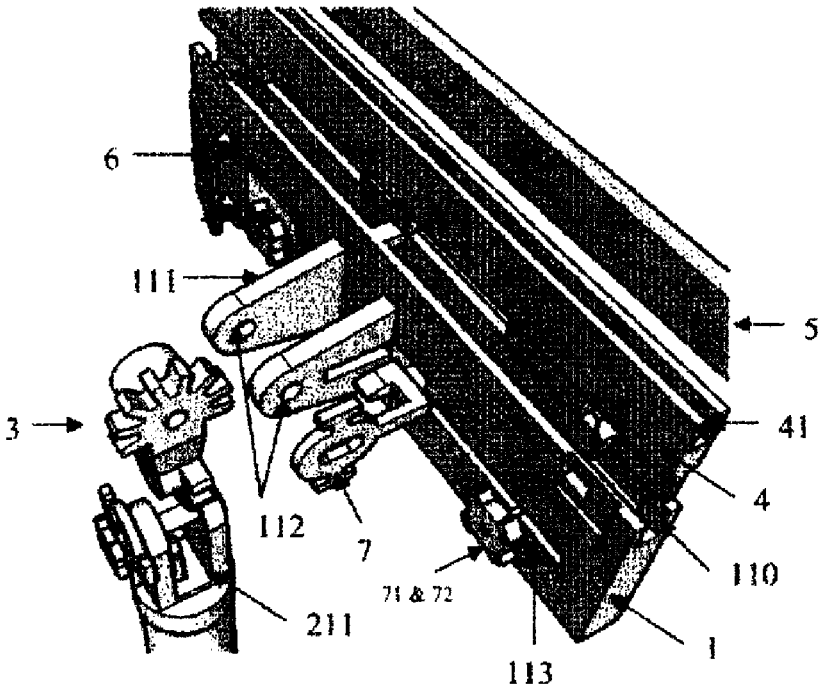
FIG. 11 shows components of squeegee head, squeegee blade container, squeegee blade, swivel joint connector, and partial view of squeegee handle.

The squeegee blade container 4 with affixed squeegee blade 5 is shown at FIG. 8. The squeegee blade 5 is inserted into the groove/notch on top of the squeegee blade container 41 as shown in FIG. 11.

Figure 6:
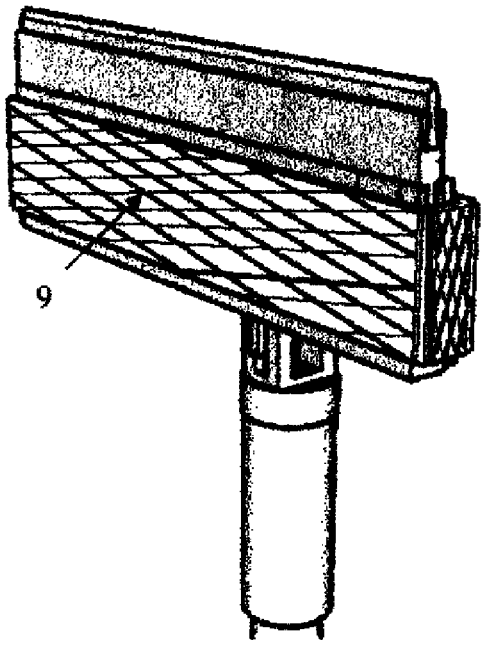
FIG. 6 shows a front view of the present invention squeegee with swiveling squeegee handle and/or squeegee head with detachable squeegee blade container with affixed squeegee blade and sprayer having a wiping material attached across the front surface of the squeegee head.
Figure 7:
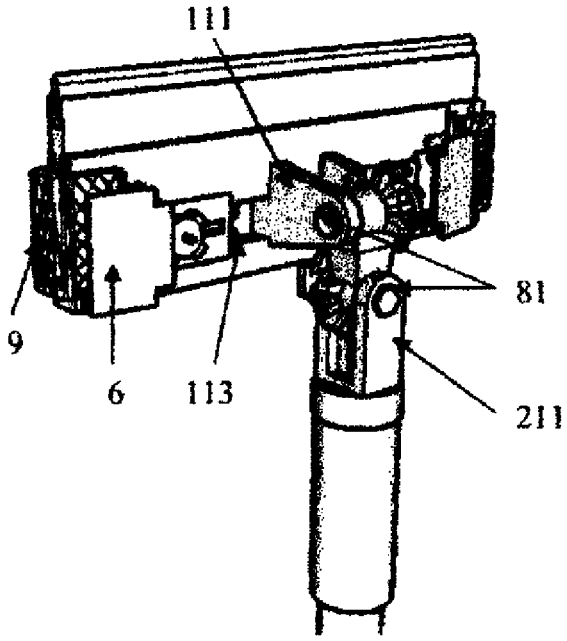
FIG. 7 shows a rear view of the present invention squeegee with swiveling squeegee handle and/or squeegee head with detachable squeegee blade container with affixed squeegee blade and sprayer having clamp like device fastening a wiping material across the front surface of the squeegee head.

FIG. 6 and FIG. 7 shows a wiping material 9 being wrapped around the squeegee head 1 and fasten by clamp like device 6 at the rear of the squeegee head 1. The tension of the wiping material attached against the squeegee head 1 is adjusted by sliding the affixed clamp like device 6. The clamps 6 are affixed to the squeegee head by nut 71 and bolt 72, and the groove/notch at the rear of the squeegee head 113 allows the clamps 6 to move laterally.

Figure 9:
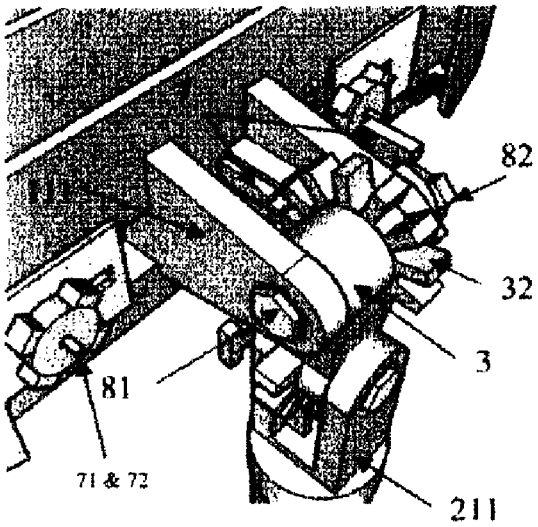
FIG. 9 shows a view of swivel joint section of squeegee head where joint is unlocked.
Figure 10:
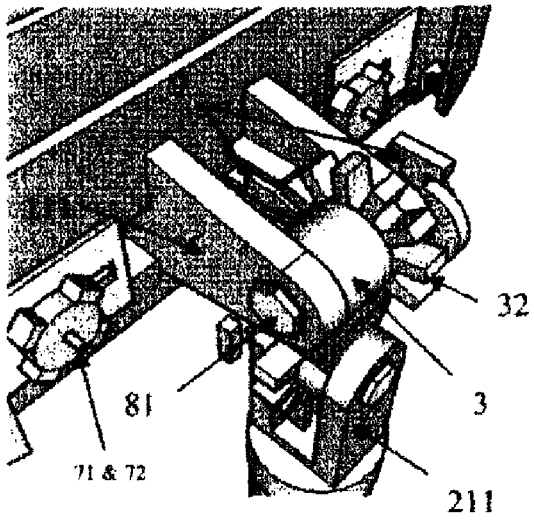
FIG. 10 shows a view of swivel joint section of squeegee head where joint is locked to prevent swiveling.

FIG. 9 shows a pair of ears 111 with bearing bore 112 of yoke clamp like device joined and connected to an end of swivel joint connector 3 by clamping bolt 81 and nut 82. Tightening the clamping bolt 81 and nut 82 increases the tension of the joint 31 and increase the resistance of swivel movement of squeegee head 1; lessens the ease of movement. The swivel joint 31 is locked into a position by moving the swivel lock 7 in-between the teeth of sprocket 32 as shown in FIG. 10. Referring to FIG. 10 and FIG. 9, the swivel joint is locked and unlocked by moving the position of the swivel lock 7.

Figure 12:
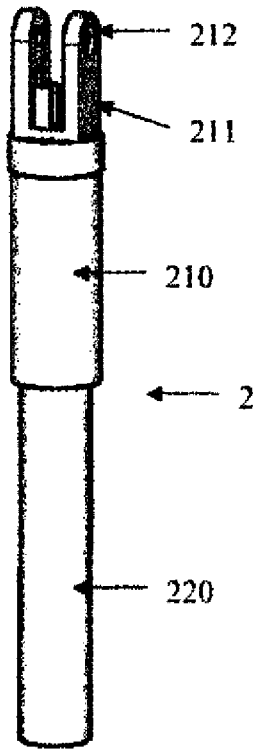
FIG. 12 shows a view of a squeegee handle of present invention squeegee with swiveling squeegee handle and/or squeegee head with detachable squeegee blade container with affixed squeegee blade and sprayer.
Figure 13:
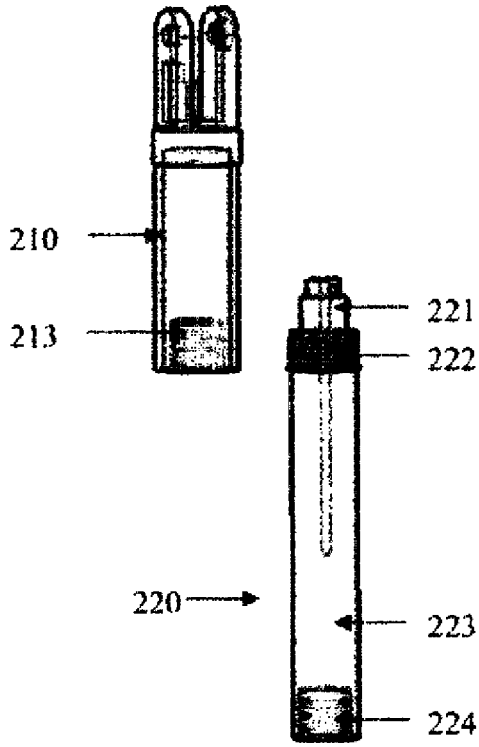
FIG. 13 shows a transparent view of a squeegee handle separated into two units of present invention squeegee with swiveling squeegee handle and/or squeegee head with detachable squeegee blade container with affixed squeegee blade and sprayer.
Figure 14:
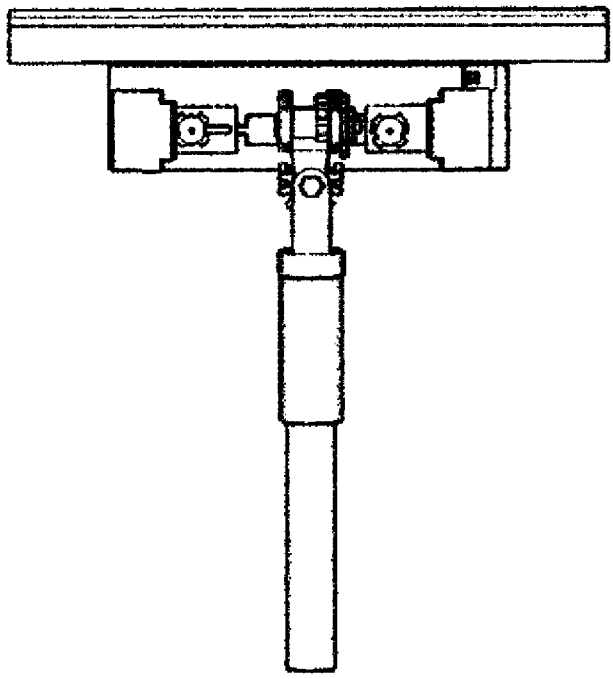
FIG. 14 shows a view of present invention squeegee with swiveling squeegee handle and/or squeegee head with detachable squeegee blade container with affixed squeegee blade and sprayer with squeegee blade and its container in longer length.

The squeegee handle 2 is shown at FIG. 12, consisting of two units 210, 220. The top end of the first unit 210 of squeegee handle 2 is a joint connector, a pair of ears 211 with bearing bore 212 of yoke clamp like device, for connection to swivel joint connector 3. The connection of squeegee handle joint connector 31 and swivel joint connector 3 allows the squeegee handle 2 to swivel laterally. The bottom end of the first unit as shown in FIG. 13 has a thread 213 for connection to the second unit 220 of the squeegee handle or an optional extended handle. The second unit 220 of the squeegee handle 2 includes a spraying system as shown in FIG. 13, having an enclosed reservoir 223 to hold liquid and sprayer/pump with nozzle 221 to dispense the liquid. The second unit 220 has threads 221 and 224 at ends, top end to connect to the first unit of the squeegee handle and the bottom end for connection to an optional extended handle. The swivel joint mechanism and its functionalities are common between the squeegee head and squeegee handle.

There are several possibilities of modification and variation of the present invention. It is therefore, the invention should not to be assessed entirely of the preferred embodiments. The scope of the claims should be assessed in order to evaluate the full scope of the invention.

What is claimed is:

1. A squeegee with a swiveling squeegee handle and a squeegee head with a detachable squeegee blade container with an affixed squeegee blade and a sprayer which comprises:

(a) said squeegee head being an elongated rectangular shape with a flat front surface where a wiping material is attached for wiping and cleaning;

(b) said detachable squeegee blade fastened on to a groove of the detachable squeegee blade container;

(c) said detachable squeegee blade container being an elongated shaped device and interlocked by means of clip-on on to a notch of the squeegee head; the squeegee blade container detachable from the squeegee head, the squeegee blade and the squeegee blade container attached and detached on to the squeegee head;

(d) said squeegee head having a joint connector having a pair of ears with a bearing bore of a yoke clamp device protruding from a rear of the squeegee head to connect to the swivel joint connector, said squeegee head having clamp devices attached at the rear of the squeegee head, the clamp devices being detachable from the squeegee head;

(e) said squeegee handle being an elongated cylindrical handle comprising of two units, a first unit having a handle joint connector, a pair of ears with a bearing bore of a yoke clamp device, at the first end for connection to the swivel joint connector, and having threads at the second end for connection to a second unit, the second unit including a spraying system and an enclosed reservoir to hold liquid, and both ends of the second unit being threaded; the first end connecting to the first unit and the second end connecting to an optional extended handle;

(f) a spraying system located within the second unit of the squeegee handle, including a pump with a sprayer with nozzle for dispensing liquid from an enclosed reservoir;

(g) said swivel joint connector interconnecting the squeegee head and the squeegee handle, the ends of the swivel joint connector comprising of sprocket component with a bearing bore; the first end for connection to the squeegee head joint connector and the second end for connection to the handle joint connector.

2. The squeegee with a swiveling squeegee handle and a squeegee head with a detachable squeegee blade container with an affixed squeegee blade and a sprayer of claim 1, wherein a wiping material attached across the front surface of the squeegee head is detachable, the wiping material is selected from one of cleaning wipes, cloth/fabric, squeegee sponge or an absorbent material or paper towel.

3. The squeegee with a swiveling squeegee handle and a squeegee head with a detachable squeegee blade container with an affixed squeegee blade and a sprayer of claim 1, wherein said clamp device affixed at the rear of the squeegee head fastens a wiping material on to the front surface of the squeegee head.

4. The squeegee with swiveling squeegee head and squeegee handle, and detachable squeegee blade container with affixed squeegee blade and sprayer of claim 1, wherein said clamp device affixed at the rear of the squeegee head has the ability to move laterally to adjust the length of the wiping material and to tighten the tension of the wiping material being attached to the squeegee head.

5. The squeegee with a swiveling squeegee handle and a squeegee head with a detachable squeegee blade container with an affixed squeegee blade and a sprayer of claim 1, wherein the joint connector of the squeegee head interlocks with the swivel joint connector allowing the squeegee head to swivel/pivot vertically.

6. The squeegee with a swiveling squeegee handle and a squeegee head with a detachable squeegee blade container with an affixed squeegee blade and a sprayer of claim 1, wherein the handle joint connector interlocks with the swivel joint connector allowing the squeegee handle to swivel/pivot laterally.

7. The squeegee with swiveling squeegee head and squeegee handle, and detachable squeegee blade container with affixed squeegee blade and sprayer of claim 1, wherein a joint locking mechanism allows extension of the squeegee head and the squeegee handle to pivot and lock to an angled position and prevents swivel movement.

8. The squeegee with swiveling squeegee head and squeegee handle, and detachable squeegee blade container with affixed squeegee blade and sprayer of claim 1, wherein a joint locking mechanism allows extension of squeegee head and squeegee handle to swivel with specified degree of resistance by means of tightening the swivel joint.

* * * * *